US007975635B2

(12) United States Patent
Greghi

(10) Patent No.: US 7,975,635 B2
(45) Date of Patent: Jul. 12, 2011

(54) FURLING AND UNFURLING DEVICE FOR ASYMMETRIC SAILS

(76) Inventor: Renzo Greghi, Milan (IT)

( * ) Notice: Subject to any disclaimer, the term of this patent is extended or adjusted under 35 U.S.C. 154(b) by 313 days.

(21) Appl. No.: 11/903,162

(22) Filed: Sep. 20, 2007

(65) Prior Publication Data

US 2008/0066668 A1 Mar. 20, 2008

(30) Foreign Application Priority Data

Sep. 20, 2006 (IT) ..... MI2006A1787

(51) Int. Cl.
*B63H 9/08* (2006.01)

(52) U.S. Cl. ..... 114/105

(58) Field of Classification Search ..... 114/104–107
See application file for complete search history.

(56) References Cited

U.S. PATENT DOCUMENTS 4,723,499 A * 2/1988 Furgang ..... 114/106
6,591,771 B2 * 7/2003 Greghi ..... 114/106

* cited by examiner

*Primary Examiner* — Ed Swinehart
(74) *Attorney, Agent, or Firm* — Hedman & Costigan, P.C.; James V. Costigan

(57) ABSTRACT

An asymmetric sail furling and unfurling device comprises a tubular outer foil and an inner stay foil, the inner and outer foils providing a foil assembly adapted to transmit a torque for furling an unhoisted sail, which is furled on a sheath foil fitted on the outer foil, with the assembly of the foils and sheath being flexible.

13 Claims, 20 Drawing Sheets

Fig. 21
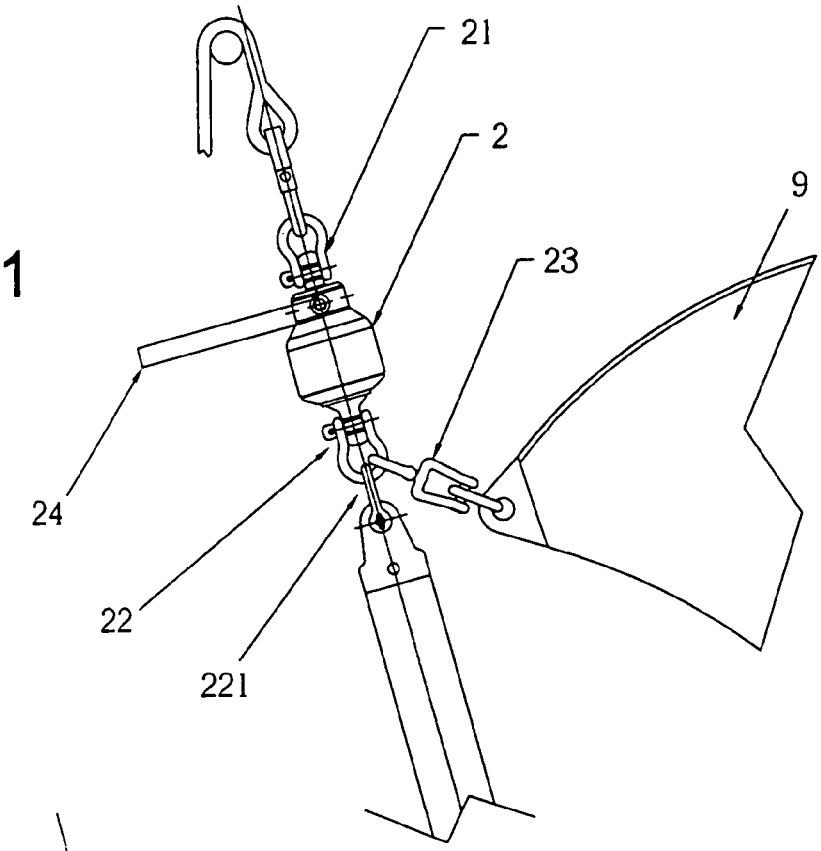
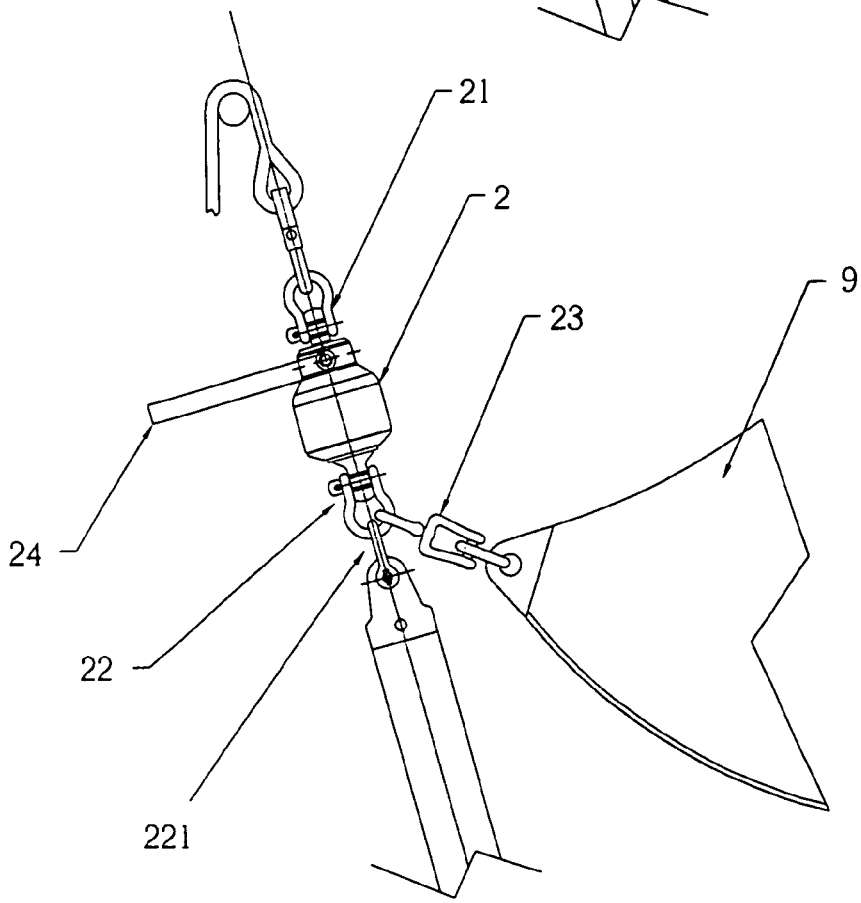
Fig. 22

Fig. 23
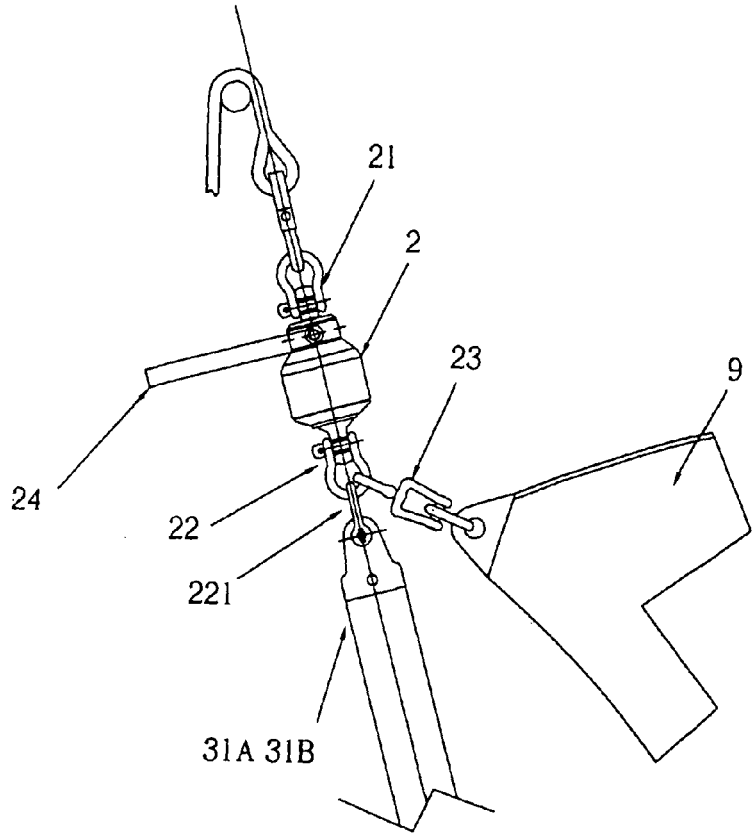
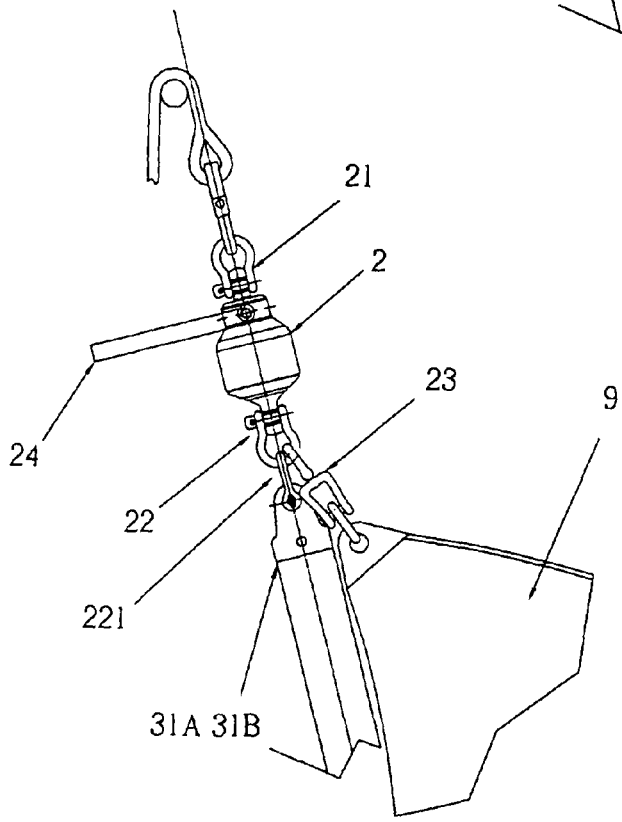
Fig. 24

Fig. 25
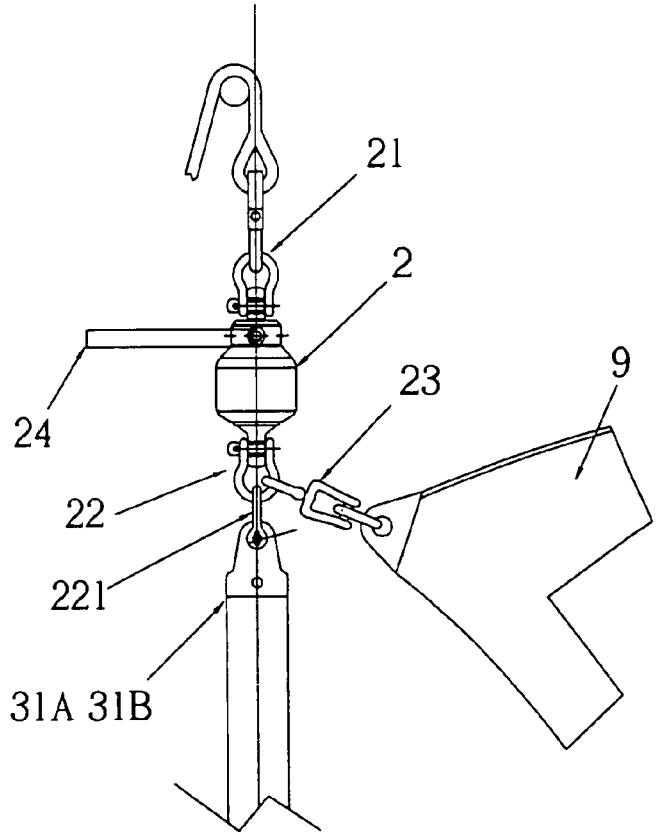
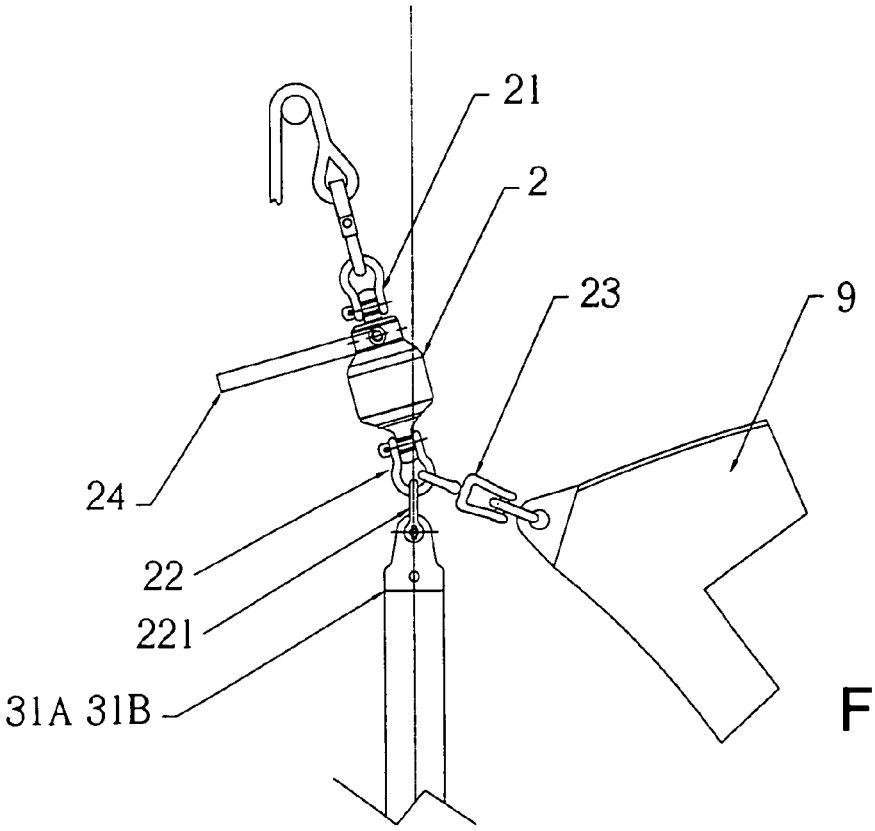
Fig. 26

FURLING AND UNFURLING DEVICE FOR ASYMMETRIC SAILS

BACKGROUND OF THE INVENTION

The present invention relates to an improved device for furling asymmetric sails.

More specifically, the present invention related to a combination of a sail and a furling device therefore, which sail can be a large head unhoisted sail, a sail for downwind operation, such as asymmetric spinnakers or like types sails, such as gennakers or MPS, that is sails for operating with the wind before the beam, such as tails, drifters, reachers.

As is known, a very important problem to be solved by cruisers sailing with a short-hand crew is that of maneuvering or handling large headsails, such as asymmetric spinnakers, or other like sails, such as gennakers or MPS.

The most common solution adopted in the prior art to facilitate sail hoisting and lowering operations on large downwind headsails, provides to use a so-called "sock" or "sleeve" equipment, containing the sail in a furled or clamped condition.

Such an equipment conventionally comprises: a funnel element made of an ABS material, integral or rigid with the sock or sheath and coupled to an endless sheet and a head block.

The endless sheet is looped back to the head block, to drive the ABS funnel element from the boat deck.

To said head block a strop is coupled, where the sail head and upper portion of the sock are affixed.

More specifically, said sock is hoisted to the mast head, and the sail bottom is connected to the swivel tack and latched to the maneuvering sheet.

The operation for inflating an asymmetric spinnaker provides to drive the endless sheet, to cause the funnel element to be hoisted to the mast head, thereby compacting the sock and freeing the sail.

For tightening the sail, the endless sheet is operated in a reverse direction, to cause the funnel element to be lowered to fully extend or spread the sail clamping sock.

Prior apparatus or equipments for performing the above mentioned operations, however, are affected by operating drawbacks which increase as the wind or strength increases.

In fact, for performing the above mentioned operations, a crew member must move toward the bow of the boat, i.e. to a poorly protected and less safe position, to operate the endless sheets and downward drive the funnel element, for tightening the sail, or upward drive it for freeing said sail.

Moreover, the sheets must be in a well accessible exposed condition, i.e. they must not be twisted around the sail, inside the sock.

Actually, a locked endless sheet would render very dangerous the sail tightening or freeing operation, both due to an unstable equilibrium condition affecting the crew member, and a possible anomalous operation of the sail which, if it is not properly tensioned in its working position, can be suddenly deflated and inflated again.

Thus, a jamming of the endless sheets would be very dangerous and difficult to be eliminated, thereby forcing the boat crew to perform an emergency operation to recover the sail.

The prior art discloses further furling devices for furling or unfurling asymmetric sails.

All the above prior constructions, however, provide that the sail is designed and made to fit the features of the furling/unfurling system.

In actual practice, very slim sails have been designed, such as tails, drifters and reachers, which can be easily furled, for sailing with the wind before the beam.

The sails are herein furled around a foil and are integral or rigid therewith, and accordingly being tensioned between tack and halyard.

However, the above prior systems are specifically suitable for very high speed boats, catamarans, or very light and planning mono-hull boats, designed for sailing with the wind before the beam.

In no case the above mentioned systems are designed or suitable for furling downwind sails, asymmetric spinnakers of standard construction or like sails, such a gennakers or MPS.

In no case the above mentioned systems are designed or suitable for furling unhoisted sails non integral with the furling profiled element or foil, such as tails, drifters, reachers.

SUMMARY OF THE INVENTION

Accordingly, the aim of the present invention is to provide such a device allowing to furl and unfurl sails non integral with the furling foil, such as asymmetric spinnakers, or sails of the same type, such as gennakers or MPS, of standard construction, or sails for operating with the wind before the beam, such as tails, drifters and reachers.

Within the scope of the above mentioned aim, a main object of the present invention is to provide such a sail furling/unfurling device which can be used in a very simple manner, and allows the sail to be hoisted and lowered in a very simple manner by a cruiser or sailor sailing with a short-hand crew.

Another object of the invention is to provide a combination of a flexible furling/unfurling device and sail, of small volume and adapted to be easily stored.

Yet another object of the present invention is to provide such a device allowing the sail to be furled on a sheath profiled element or foil made of a foamed material, while preventing the sail from being stretched or ripped during the furling and storing operation thereof.

Yet another object of the present invention is to provide such a sail furling/unfurling device allowing the sail to be easily unfurled at the cockpit, i.e. the most protected and safe position onboard.

Yet another object of the present invention is to provide such a sail furling/unfurling device allowing to adjust the shape of the sail, to fit it to different directions of the wind, by using a control system for controlling the shape of the sail at the inlet edge of the wind, and to be driven from the boat cockpit.

According to one aspect of the present invention, the above mentioned aim and objects, as well as yet other objects, which will become more apparent hereinafter, are achieved by a combination of a sail and a furling device therefor, characterized in that said combination comprises a flexible two-cable or single-cable inner stay foil, an outer foil comprising a plurality of tubular segments with flexible coupling elements, designed for transmitting a torque as required for furling a sail on a sheath foil fitted on the outer foil and a control system for controlling the shape of the sail at the wind inlet edge by a bottom loading system.

BRIEF DESCRIPTION OF THE DRAWINGS

Further characteristics and advantages of the present invention will become more apparent hereinafter from the following disclosure of a preferred, though not exclusive, embodiment of the invention, which is illustrated, by way of an indicative, but not limitative, example in the accompanying drawings, where:

In FIGS. 9, 10 and 11 show the segments of the outer profiled element or foil comprising two adjoining and integral tubular elements;

FIGS. 12, 13 and 14 are further detail views showing that the segments of the outer foil have a tubular shape;

FIGS. 21 and 22 are schematic views illustrating an asymmetric sail top swivel shackle, the sail and attachment terminal, during a sail tack changing operation, as aided by said top swivel shackle;

FIGS. 23 and 24 are further schematic views illustrating the asymmetric sail top swivel shackle, the sail and attachment terminal, during a furling operation;

FIGS. 25 and 26 are further schematic views illustrating the asymmetric sail top swivel shackle, the sail, attachment terminal, halyard swivel and clamping terminal, in two operating steps;

DESCRIPTION OF THE PREFERRED EMBODIMENTS

Figure 1:
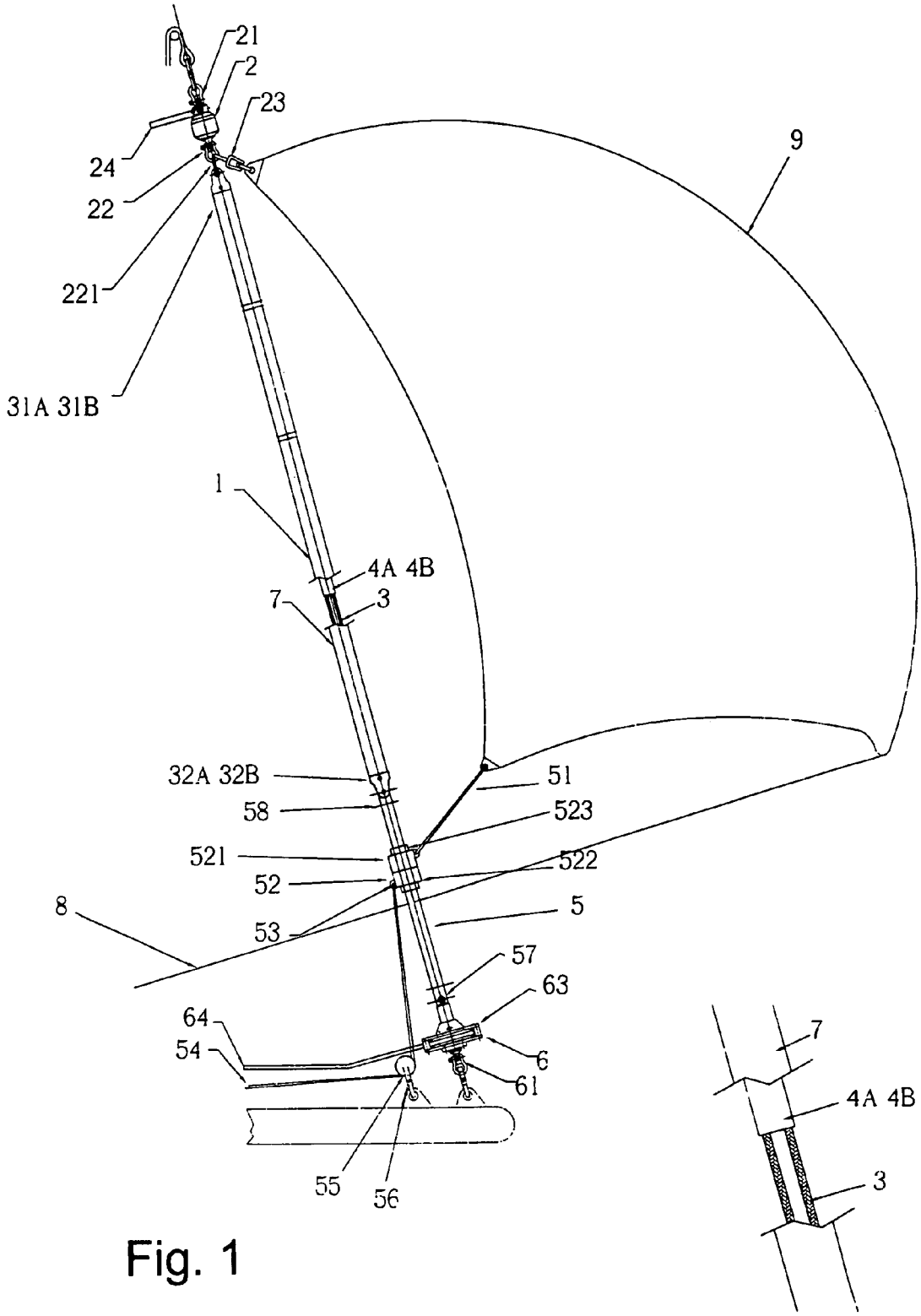
FIG. 1 is a schematic side elevation view of the device according to the invention, as applied to a downwind foresail or head sail of a sail boat.

With reference to the number references of the above mentioned figures, the sail furling device, according to the present invention, which has been generally indicated by the reference number 1, comprises a flexible single-cable (FIG. 5.) or two-cable stay (FIG. 4) profiled element or foil 3 arranged inside a tubular profiled outer (the term "outer" being used wigh respect to the inner foil element or foil including a plurality of segments formed by two adjoining and integral tubular elements 4A, or tubular segments 4B; the profiled elements or foil further comprising spacer or intercoupling elements and flexible coupling elements.

The foils 4A and 4B are adapted to transmit the torque necessary for furling a sail 9; on the tubular foils, moreover, a sheath foil or profiled element 7 is fitted or sleeved.

The inner foil, or profiled element or stay 3, comprises, for example, a sheet or rope.

The tubular foil 4A is made of a series of segments each including two adjoining tubular elements 41A, integral with one another and made of a metal material or of a fiber reinforced plastics material, spaced from one another by a plurality of flexible spacer elements 42A made of a plastics material.

At even spacings, on the foil 4A a detent element 43A for the sheath is assembled.

The segments of the outer foil 4A are held in their set positions by the inner stay foil 3.

According to a further aspect of the present invention, the outer profiled element or foil 4B comprises a plurality of rods constituted by a series of tubular segments 41B of a metal material, or a fiber reinforced plastic material.

A plurality of flexible coupling elements 42B, made of a plastic material, are provided for connecting and making integral with one another the tubular segments.

Two intercoupling elements 44B, made of a metal material, connect said rods, and on each said rod being assembled a detent element for the sheath 43B.

The intercoupling elements 44B are formed by elements 441B, 442B, 443B.

The flexible spacer elements, or connecting elements, mounted on the foils 4A and 4B allows the furling system to be easily folded and stored.

More specifically, the sheath foil 7 comprises, for example, a foamed rubber, as profiled or contoured in a particular manner, having a suitable size and tubular shape, with furling diameter increasing projecting or boss portions, which provide a satisfactory mechanical resistance and a small weight.

The furling device 1 comprises, as essential components thereof, a halyard swivel or rotary head 2, having a halyard attachment terminal or fitting 21, two inner foil or stay attachment terminals or fittings 22 and 221, and a sail top swivel shackle 23 and an anti-rotation rod or detent element 24.

The anti-rotation rod 24 prevents the torque provided by the furling system from twisting the halyard.

The inner foil or stay is connected to the halyard swivel 2 by a terminal element or fitting 31A and to a furling drum 6, through a terminal element or fitting 32A.

Arranged between the terminal element or fitting 32A and furling drum 6 is provided the control system for controlling the position of the sail tack point, or the subject bottom loading system 5.

According to a second modified embodiment, the foil 3 is coupled to the halyard swivel 2 through a terminal 31B and the furling drum 6, through a terminal 32B.

The bottom loading system 5, for controlling the sail tack point 5 is arranged between the terminal 32B and furling drum 6.

The segments of the foil 4A are held at their set or target position by the foil 3 and are arranged between the terminals 31A and 32A, connected to the halyard swivel 2, through a terminal 31A and the furling drum 6 through a terminal 32A.

The bottom loading control system 5 is arranged between the terminal 32A and the furling drum 6.

According to a further aspect of the invention, the rods of the foil 4B are connected with one another by the terminal 44B and are further coupled to the halyard swivel 2 by a terminal 31B and furling drum 6, through a terminal 32B.

The bottom loading control system 5 is arranged between the terminal 32B and furling drum 6.

The segments of the sheath foil 7 are fitted or sleeved on the rods of the foils 4A and 4B, to freely turn thereon, and are held in their positions by the detent elements 43A and 43B.

The furling drum 6 comprises an attachment terminal 61 for coupling to the boat deck (not shown), and comprises moreover an endless line kit 63, with a related top circuit 64, for furling or unfurling the sail.

Said endless top circuit 64 is coupled to the cockpit by a suitably coupling system, of a per se known type.

On said furling drum 6 a rigid foil 5 and a slider 52 with related rotary elements are mounted.

The rigid foil 5, in particular, is coupled to the furling drum 6 through an articulated terminal 57 and to the clamp 32A or 32B by a further articulated terminal 58.

The slider 52 comprises two independently rotary portions 521 and 522, mounted on a bush 523 sliding on the rigid foil 5.

The top portion 521 comprises the asymmetric sail shackle and halyard strop assembly 51.

The bottom portion 522 comprises an attachment terminal 53 coupled to the line 54.

The line 54 is directed back to the boat deck through the pulley 55 and related attachment terminal 56.

The line 54 is further coupled to the cockpit by a suitably coupling system, of a per se known type.

The operating principle of the system is based, from a dynamic standpoint, on furling the sail starting from the head portion thereof, due to the torsion provided on the halyard swivel 2 by the terminal 32A.

The latter is driven or entrained either by the inner foil 3 which, being locked in a position parallel to the outer foil 4A, transmits the driving torque, or by the terminal 32B driven by the foil 4B which, independently from the inner foil 3, transmits said torque.

In particular, said torque is transmitted by the foil 5 to the furling drum 6, in turn driven from the cockpit through the endless line 64, whereas the sail swivel tack 51 does not follow the furling movement, since it is rigid with the top rotary part 521 of the slider 52.

The line 54 does not follow the furling movement, since it is integral or rigid with the bottom rotary part 522 of the slider 52.

The sail is wound on the segments of the sheath profiled element 7, as entrained or driven by the swivel shackle or terminal 23.

The furling operation, in particular, proceeds from the top toward the bottom: at first the sail head portion is furled and then the central portion up to entrain the swivel tack 51 of the sail bottom.

The portion of the sail coupled to the driving foil or sheet 8 is wound or furled by the furling system.

The operating principle of the system, during an unfurling operation is based, from a dynamic standpoint, on the sail spreading action, provided by pulling the driving sheet 8.

The outer foil 4A, entrained by the inner foil or stay 3, while assuring a necessary flexibility during the sail storing operation, is adapted to transmit the necessary torque to the halyard swivel 2, the inner foil 3 further supporting the pulling load during the sail operating step.

In a second embodiment, the rod outer foil 4B, while assuring a necessarily flexibility during the sail storing operation, is adapted to transmit the necessary torque to the halyard swivel 2, whereas the inner foil 3 does not participate to the torque transmission, but supports the pulling load during the operating step.

The segments of the sheath profiled element 7, on which the sail is furled, do not cause any deformations or tearings of the sails, both during the furling operation and during the bag storing step.

The size of the sheath profiled element 7 is so designed as to provide, during the sail unfurling operation, the necessary torque, by removing the drive sheet 8 from the rotary center, on which said sail is furled.

Figure 4:
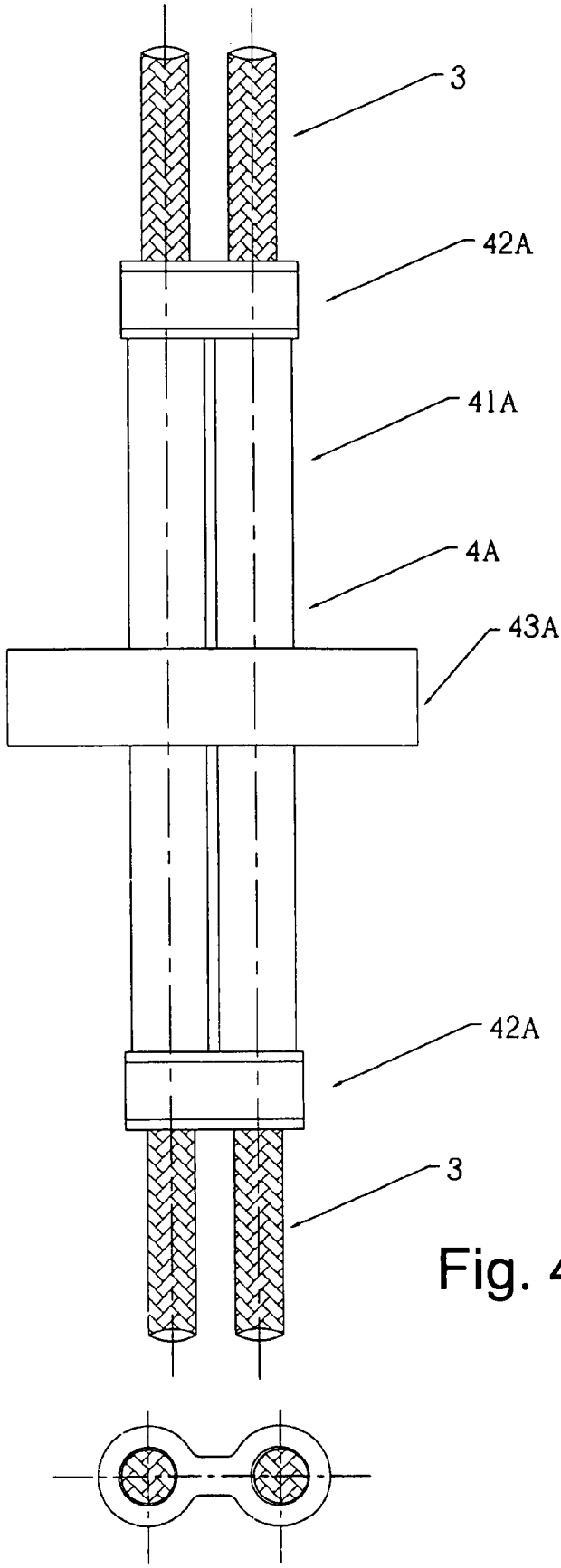
FIG. 4 is a detail view of a further embodiment of the sail furling device according to the present invention, showing a segment of the tubular outer foil comprising two adjoining and integral tubular elements and a detent ring for the sheath foil or profiled element, the number and arrangement of said segments depending on the flexability and, in general, on the required sailing characteristics of the sail.

FIG. 4 shows a detail of the profiled or foil element 4A.

The segments 41A are held in their target positions by the inner foil 3, and therebetween a flexible spacer element 42A is arranged.

A detent element 43B hold in its desired or target position, the sheath profiled element or foil 7.

Figure 5:
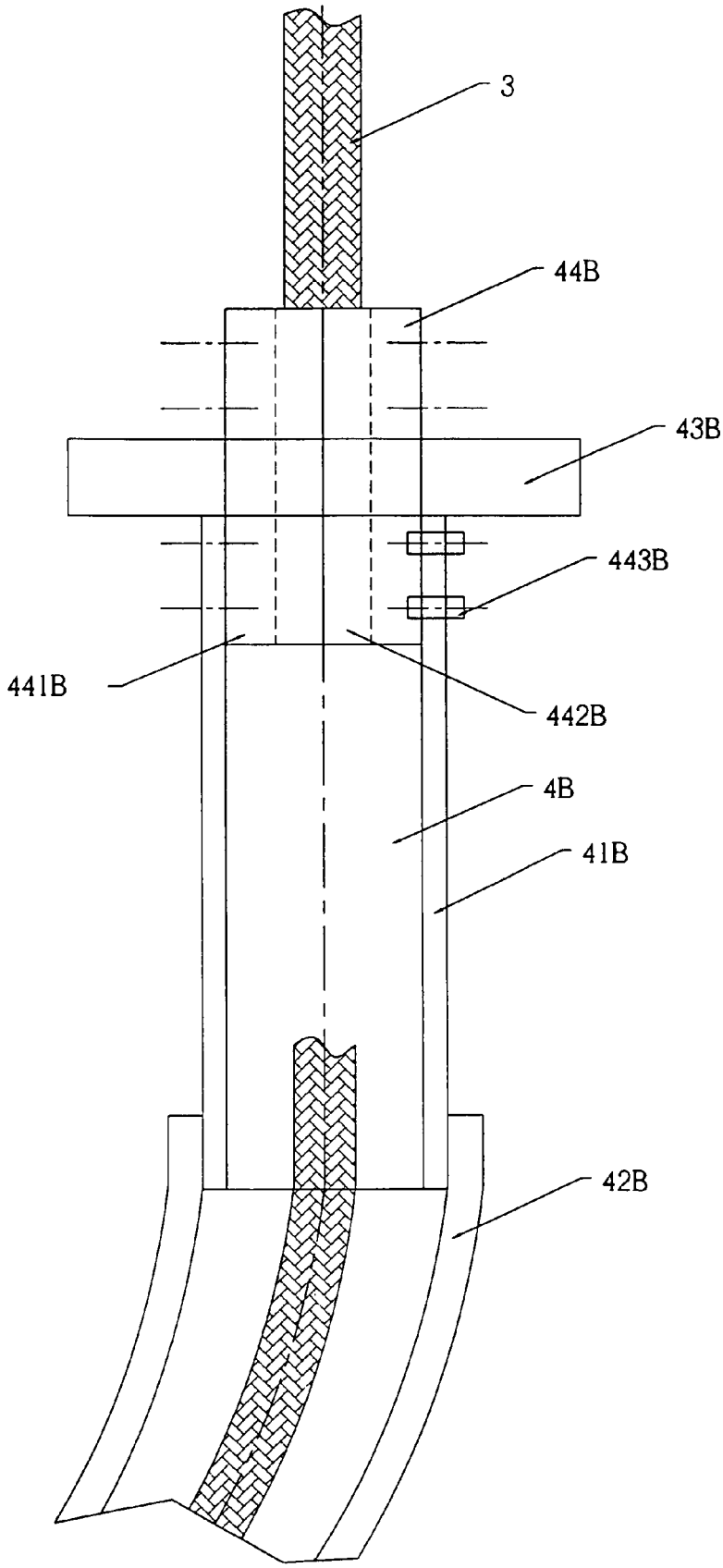
FIG. 5 is a further detail view of a further embodiment of the sail furling device according to the invention, and specifically showing the outer tubular foil the including a single tubular element including a plurality of intercoupling elements and flexible coupling elements, said flexible coupling elements being made integral with foil segments, the intercoupling elements including moreover a detent ring with the number and arrangement of the segments depending on the flexibility and in general by the required sailing characteristics.
Figure 6:
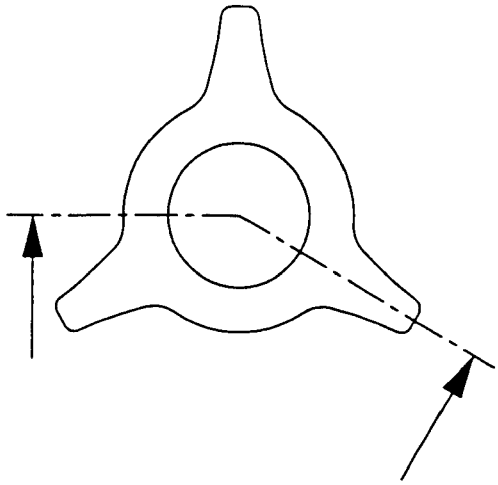
FIG. 6 shows a segment of the tubular sheath foil including projecting portions.
Figure 6:
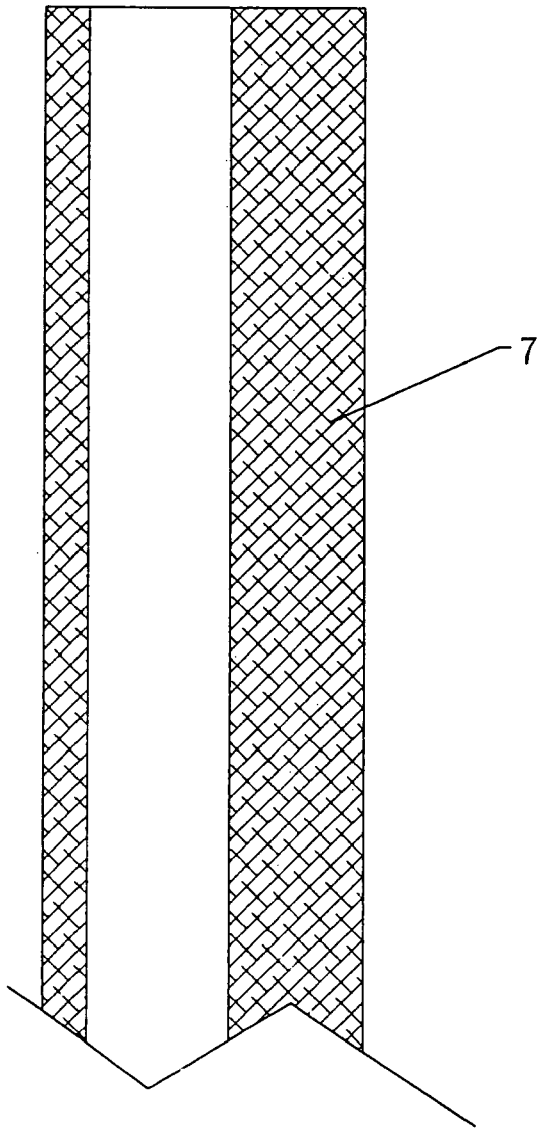
Figure 7:
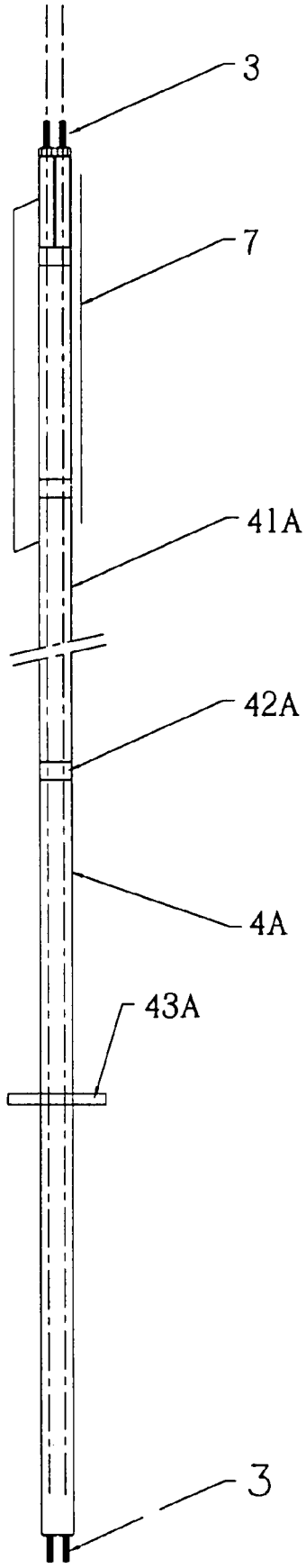
FIG. 7 is a cross section view of the sheath foil including two tubes, the assembled segments of the outer foil element, joined on the inner foil element, forming the stay on which the sail is furled, the sheath foil being fitted or sleeved on the outer foil.
Figure 8:
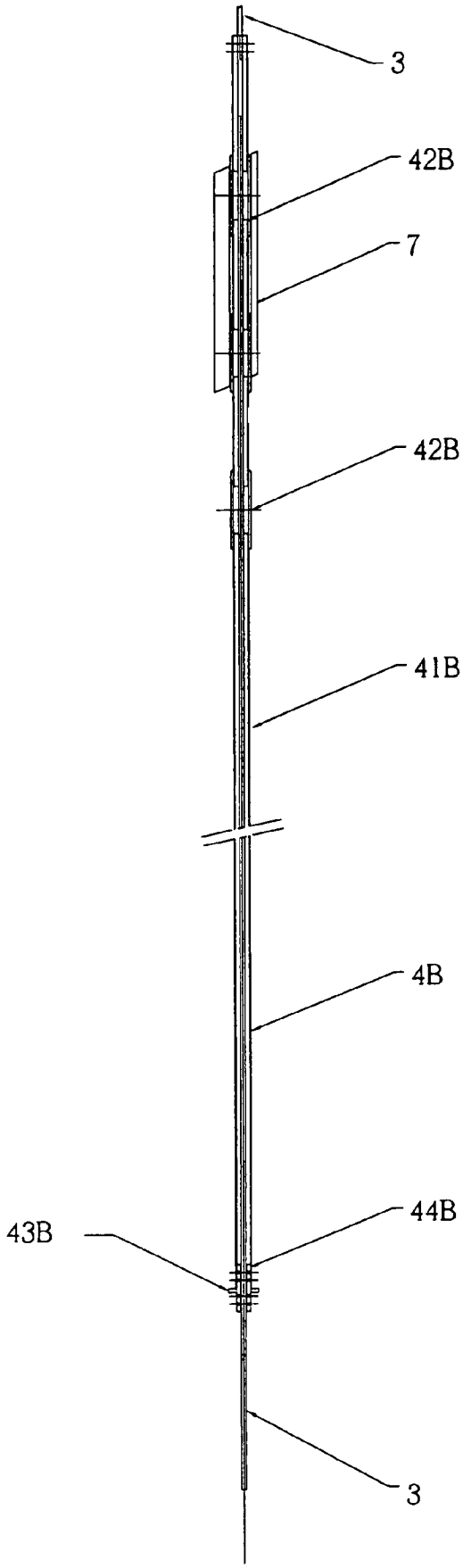
FIG. 8 is a cross sectional view of the tubular foil, the assembly of the outer foil segments defining a bar, the bars being joined on the inner foil by intercoupling elements forming the stay thereon the sail is furled, the sheath foil being fitted or sleeved on the outer foil.

FIG. 5 shows a detail of the foil 4B.

The segments 41B coupled by the flexible coupling elements 42B, form rod or bar elements.

The coupling element 42B integrally connects the segments 41B, said rods or bars being in turn coupled by two rigid coupling elements 44B.

The rigid coupling elements 44B comprise two portions 441B and 442B, said coupling elements integrally coupling the rods or bars by coupling screws 443B.

The detent element 43B holds in its target position, the sheath foil.

Figure 9:
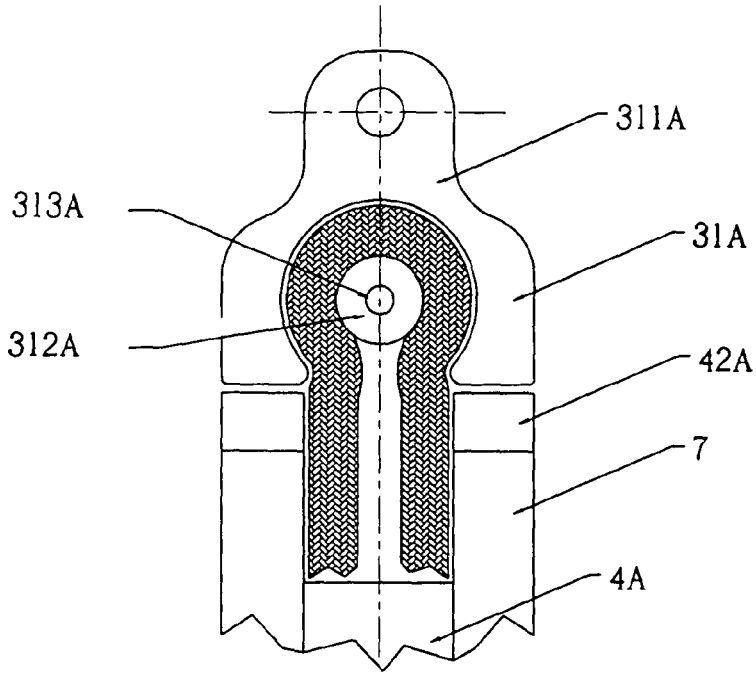
FIG. 9 is a further longitudinal cross sectional view of a detail of a coupling terminal between the rotary head or halyard swivel and the inner foil.

FIG. 9 shows the terminal 31A comprising a bottom 311A, a closure flange 312A having a respective recess for the foil 3 and a bolt 313A, and related locking nut.

Figure 10:
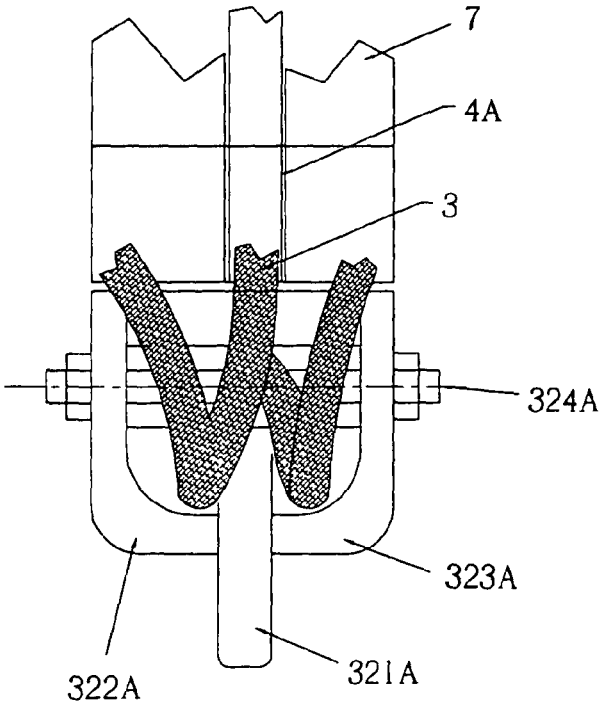
FIG. 10 is a cross sectioned view of a detail of the coupling terminal coupling the furler or furling drum and the inner stay foil, between the terminal and the furler being arranged the subject bottom loading system.
Figure 11:
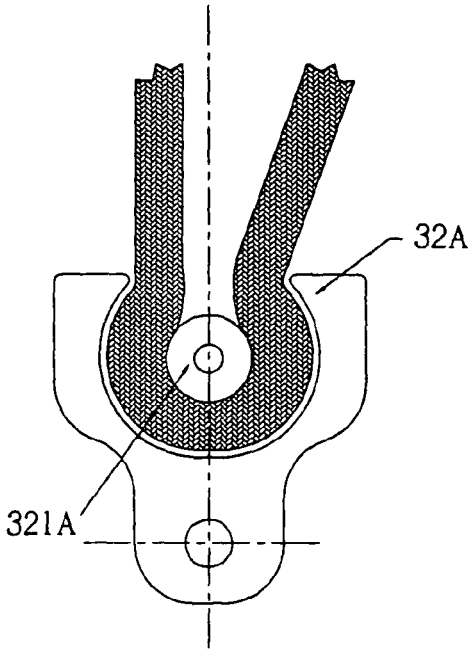
FIG. 11 is a further longitudinal cross sectional view of a detail of the terminal of FIG. 10.

FIGS. 10 and 11 are further detail views showing the construction of the terminal clamp 32A comprising a bottom 321A and related recess for the foil 3, two closure flanges 322A, 323A and a bolt 324A and related locking nut.

FIGS. 9, 10 and 11 show the locking of the foil 3 on the terminals 31A, 32A.

Figure 12:
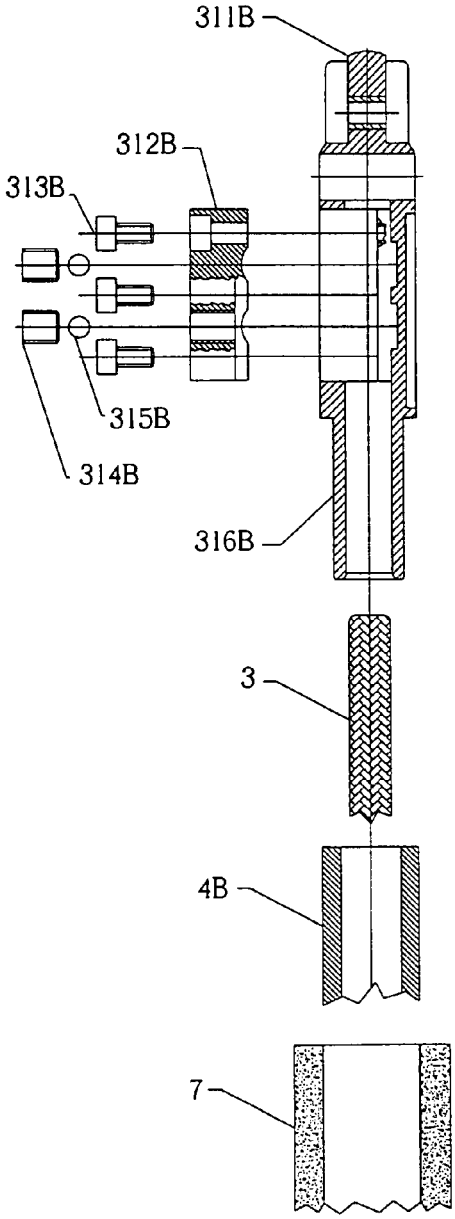
FIG. 12 is a cross sectional view of an exploded detail of the coupling terminal for coupling the halyard swivel or rotary head and the inner stay foil, and the top rotary head and the outer foil.
Figure 13:
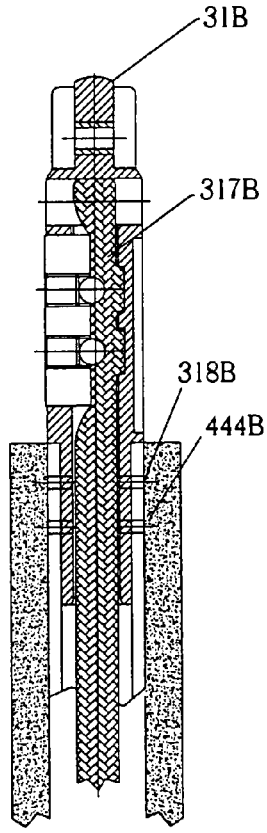
FIG. 13 is a cross sectional view of a detail of the terminal of FIG. 12.
Figure 14:
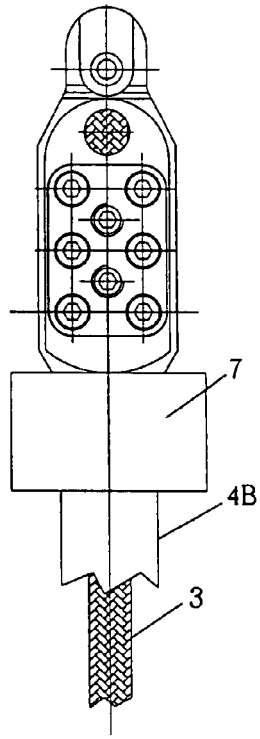
FIG. 14 is a further detail view of a front detail of that same terminal.
Figure 15:
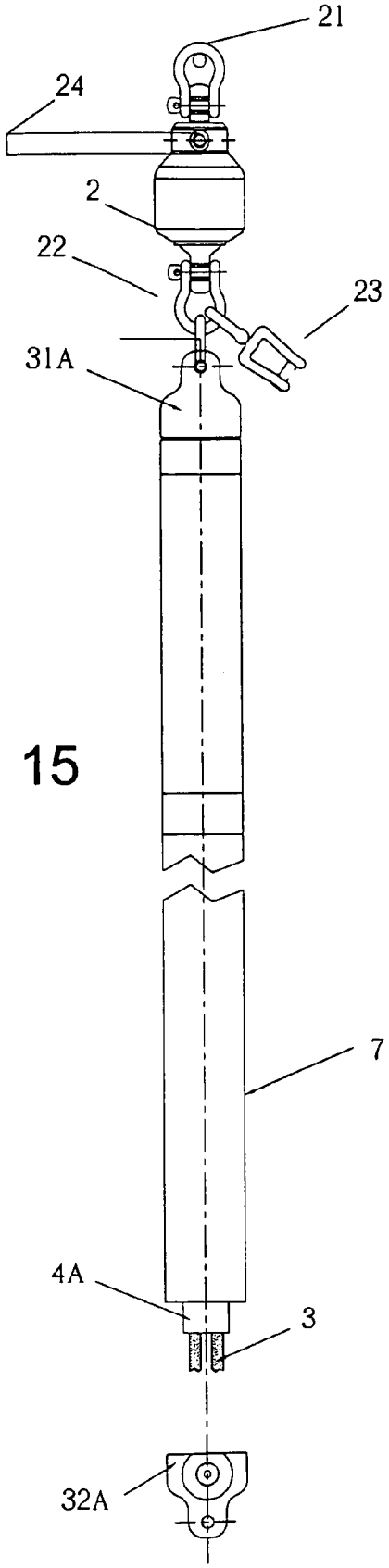
FIGS. 15, 16 and 17, 18 show two embodiments of the double-pipe foil or profiled element and single-pipe foil or profiled element, and further show a procedure for using the clamping terminals 32A and 32B for installing the equipment or device onboard to lock the profiled or foil elements, after having set the assembling measurements.
Figure 16:
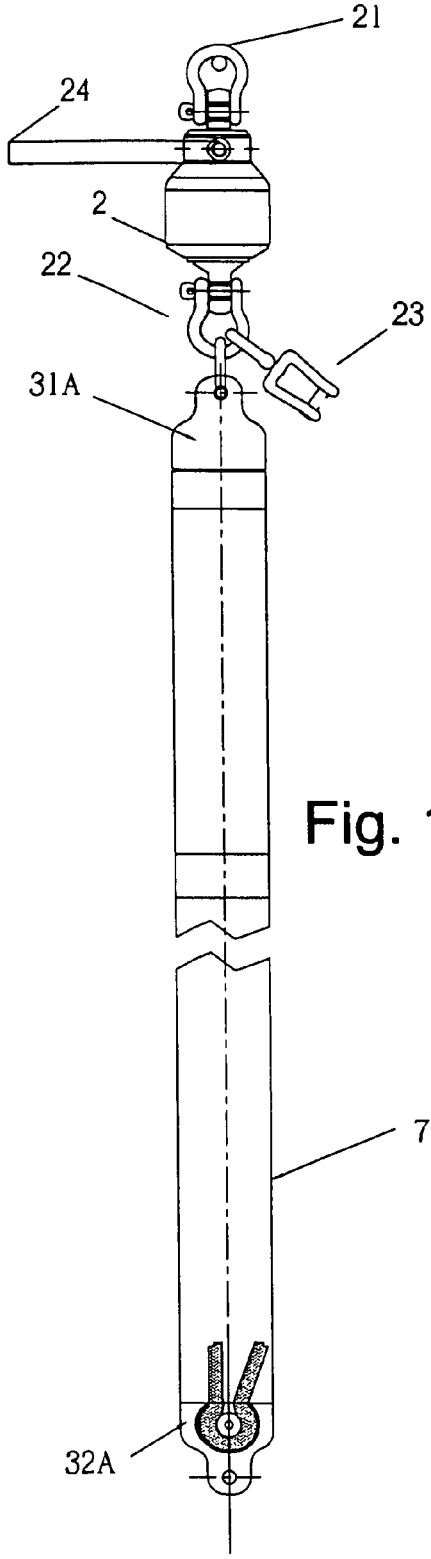
Figure 17:
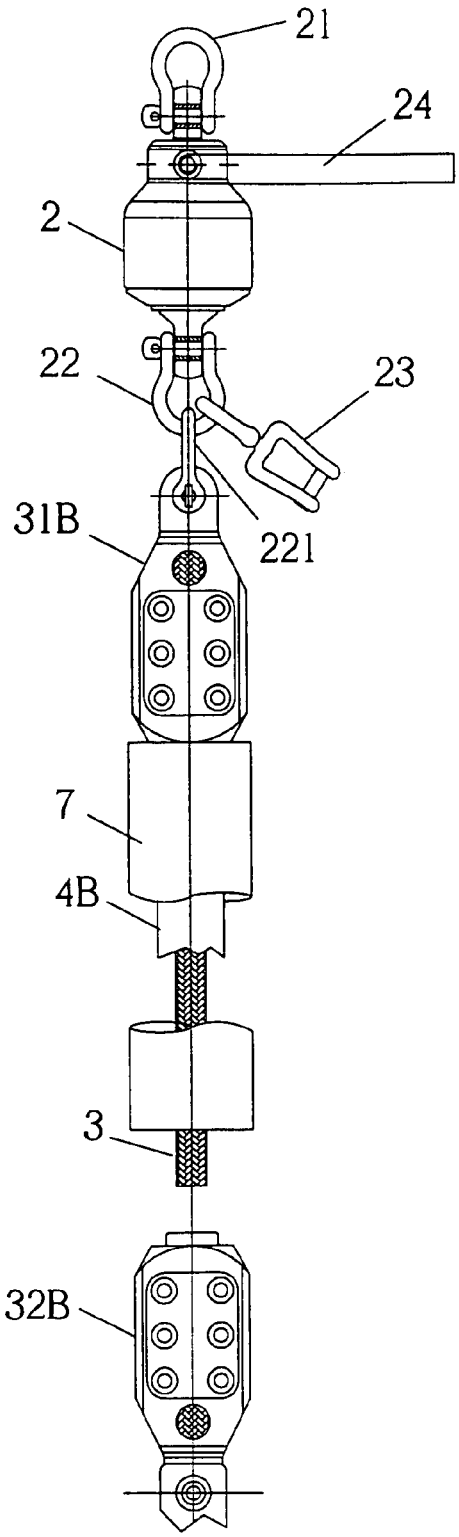
Figure 18:
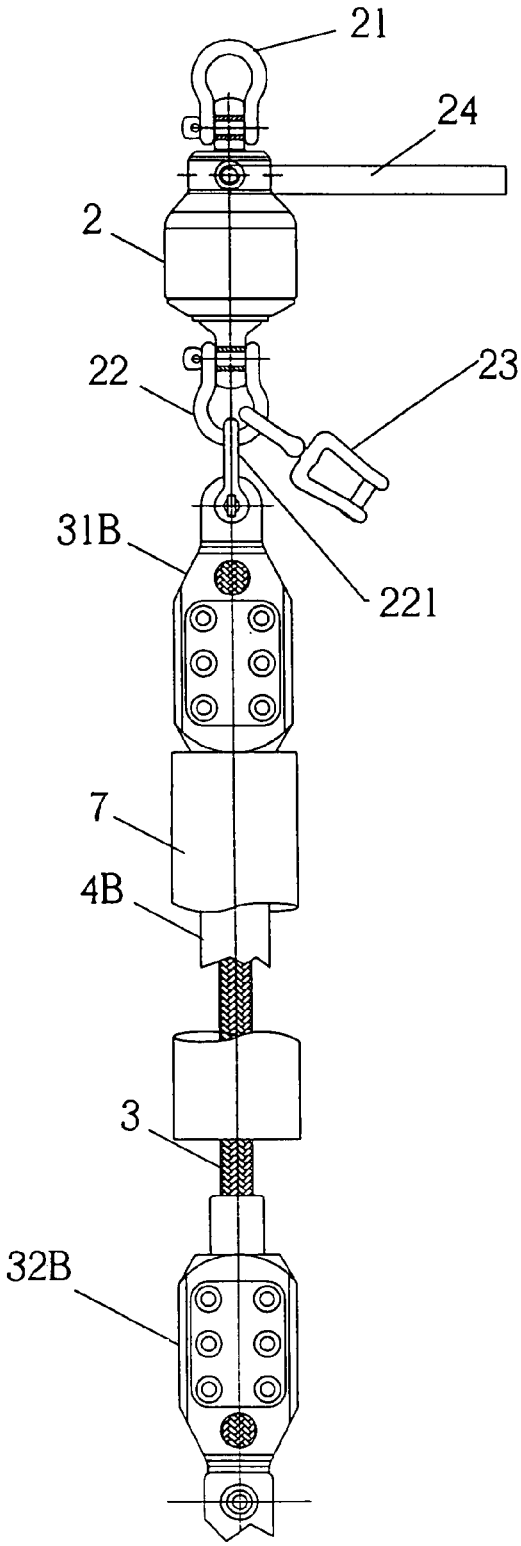
Figure 19:
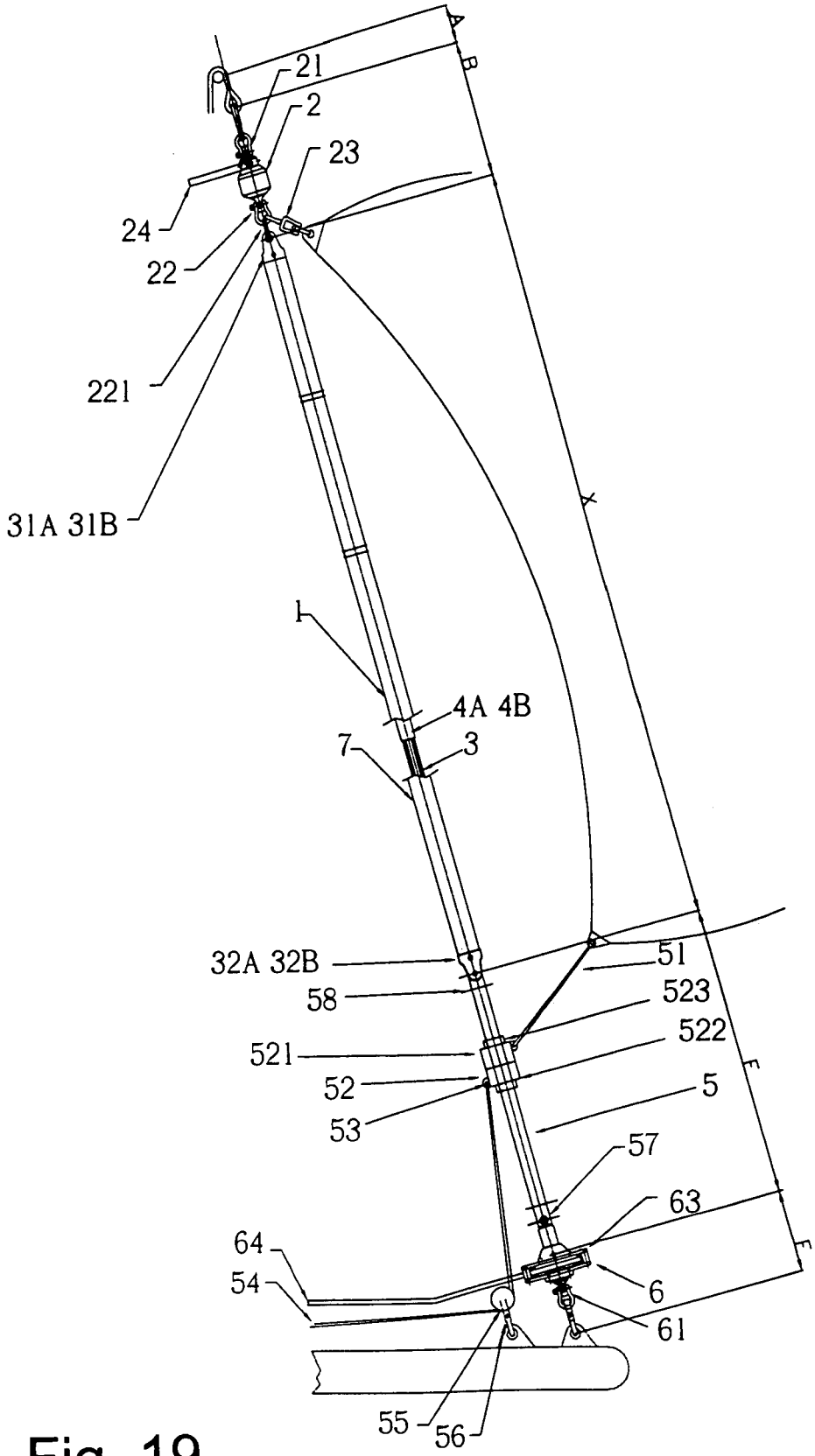
FIG. 19 is a detail view of the device with the measurements for installing it.
Figure 20:
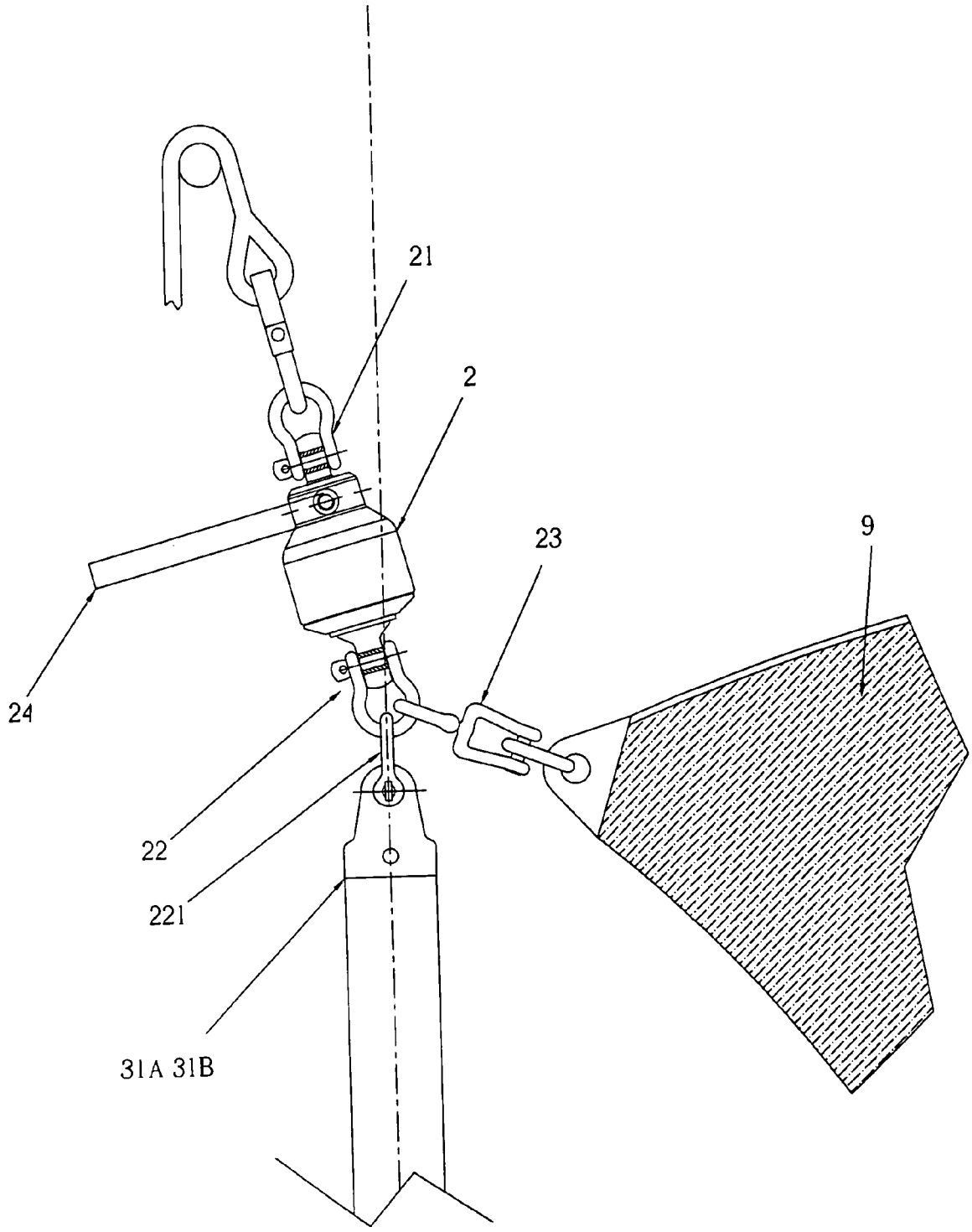
FIG. 20 shows the asymmetric sail top swivel shackle and sail, and further shows an inner profiled element or foil attachment terminal, a halyard swivel, an asymmetric sail top swivel shackle and two fastening elements therefor.

FIGS. 12, 13 and 14 are further detail views showing the construction of the terminal clamp 31B, comprising a bottom 311B, a closure flange 312B, locking screws 313B, stop dowels 314B and related ball elements 315B, and a collar 316B for housing the foil 4B therein.

Locking screws 444B being moreover shown.

In particular, the figures show the locking of the foil 3 on the terminal clamp 31B, see the reference number 317B.

Said figures show moreover the locking of the foil 4B on the terminal clamp 31B, see the reference number 318B.

The bottom terminal clamp 32B is substantially identical to the above disclosed clamp 31B, and also comprises a bottom, a closure flange, locking screws, and stop dowel-ball element assemblies.

FIGS. 21-22 schematically show the asymmetric sail top swivel shackle 23, the sail 9 and attachment terminal or fitting 22.

In particular, said figures show that the sail pack change is aided by said sail top swivel shackle 23.

FIGS. 23-24 shows that, during the furling step, the resisting torque is minimum, thereby greatly facilitating the operation.

FIGS. 25-26 show that, in the working step, i.e. under the pulling force provided by the sail 9 through the sail top swivel shackle 23 on the attachment terminal 22, the assembling system herein disclosed allows the components of the halyard swivel 2 and terminal clamps to operate on an optimum axis, thereby providing a maximum efficiency and a minimum wear.

Figure 27:
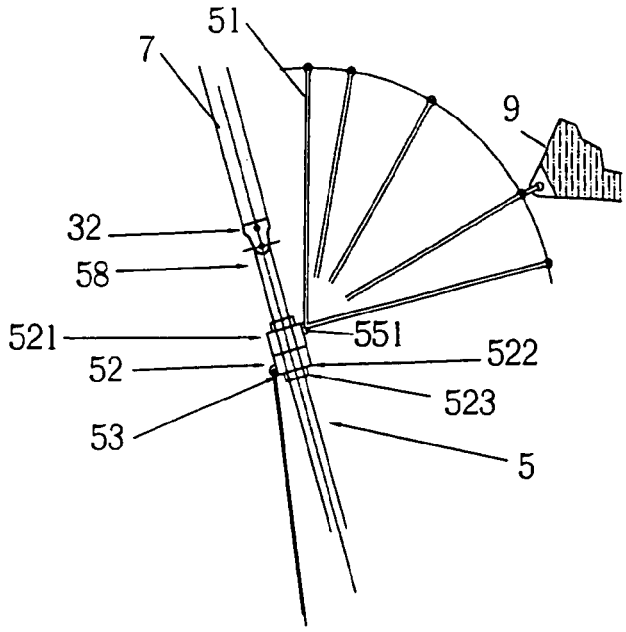
FIG. 27 schematically illustrates the movement of the semirigid rod or arm of the swivel tack.

FIG. 27 shows the use of the swivel tack semi-rigid rod 51 for downwind sails, FIG. 1, such as asymmetric spinnakers, or sails of the same type, such as gennakers or MPS's.

Said swivel tack semirigid rod 51 cannot be lowered under the position schematically indicated in this figure, since the pin element 511 provides a detent or stop function.

FIG. 27 shows, in a furling operation and in absence of wind, that the system prevents the sail 9 from falling downward under the rotary plane of the furling drum 6.

The swivel tack semi rigid rod 51 is so designed as to increase the resistance to the furling torque, preventing the sail from being furled at the bottom portion thereof, before having completed the furling of the sail head and middle parts.

This feature will provide a proper operation, under any operating conditions.

Figure 2:
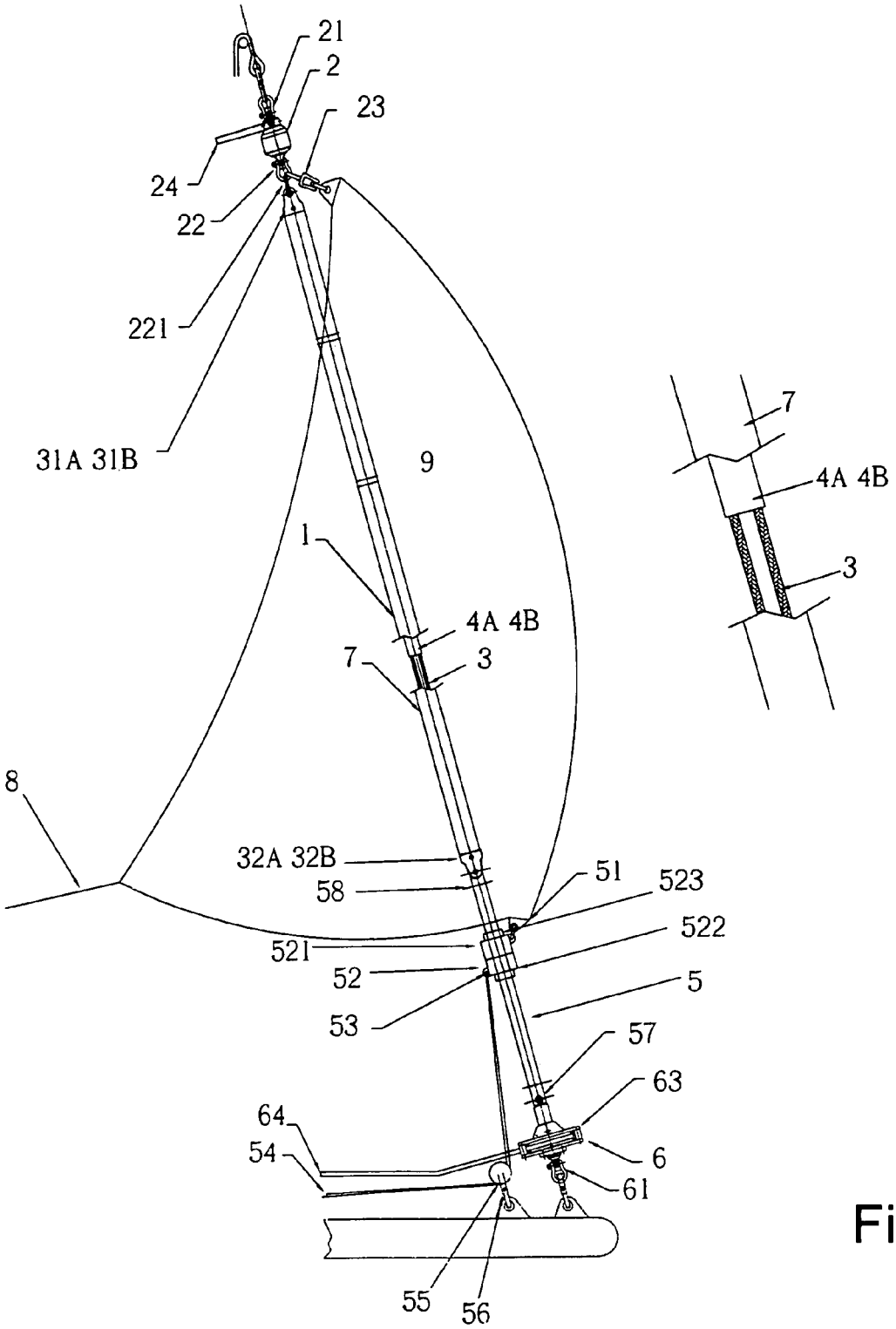
FIG. 2 is a further schematic side elevation view, of the subject device, applied to a sail provided for operating toward the wind.
Figure 3:
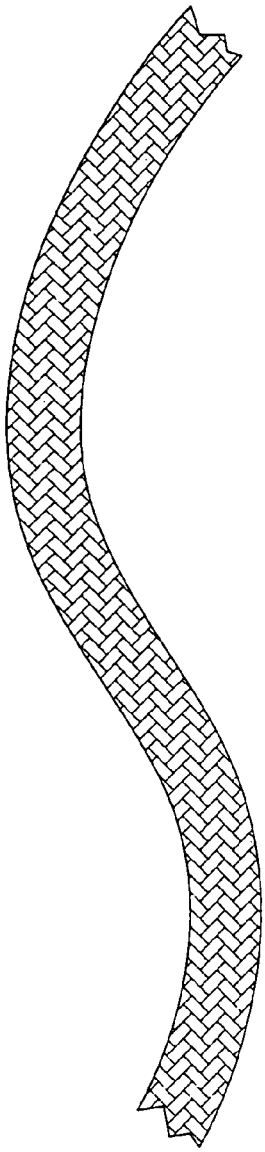
FIG. 3 is a detail view of a detail of the furling device according to the invention, showing the inner flexible stay foil or profiled element.
Figure 28:
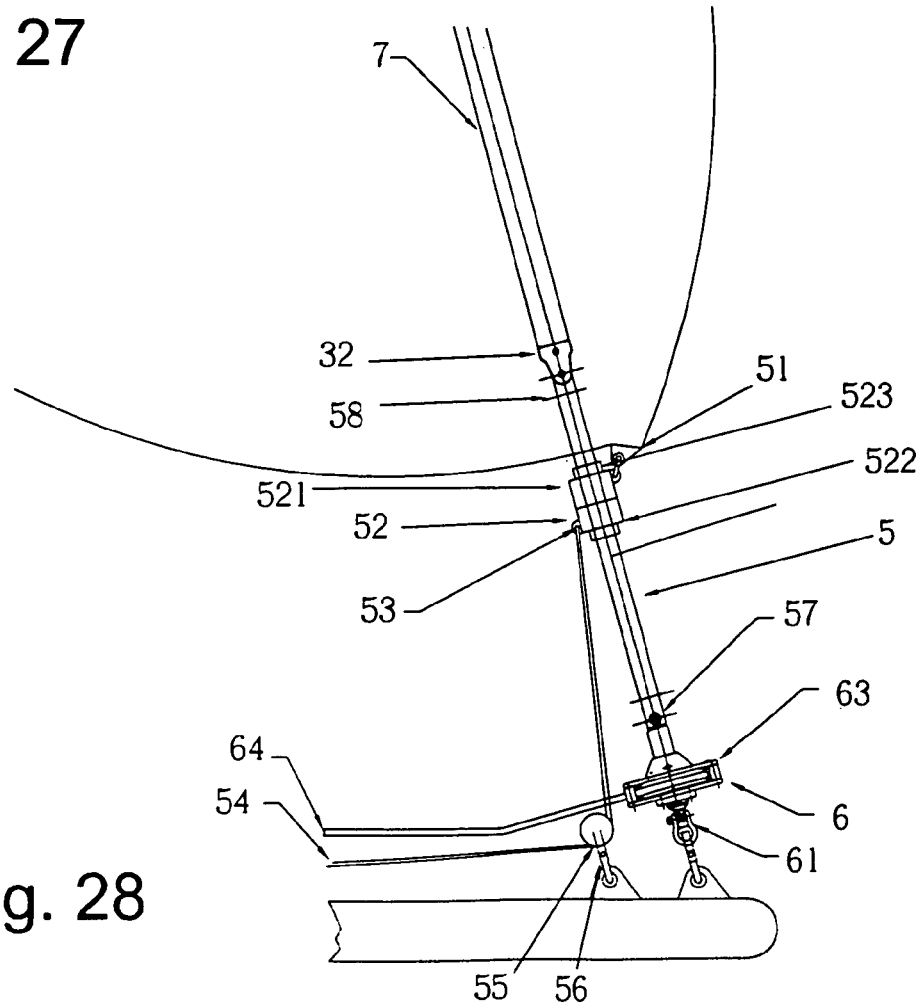
FIG. 28 schematically illustrates the bottom loading system for controlling the shape of the sail at the inlet wind inlet edge.

This feature, on the other hand, is not necessary for sails, such as tails, drifters and reachers, see FIG. 28 and FIG. 2.

Figure 29:
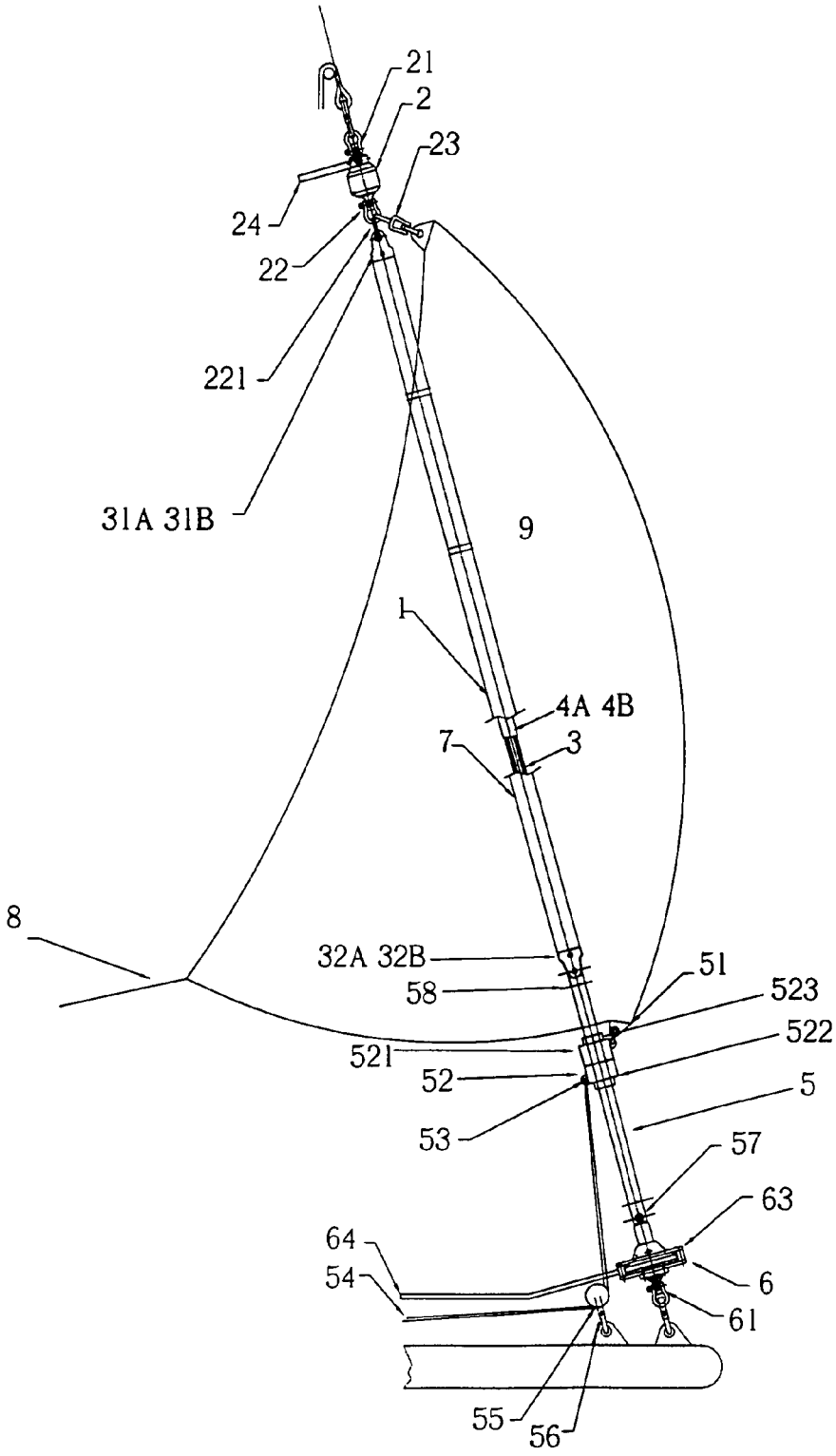
FIGS. 29-30 show how the bending of the sail inlet edge is modified by operating the low loading system.
Figure 30:
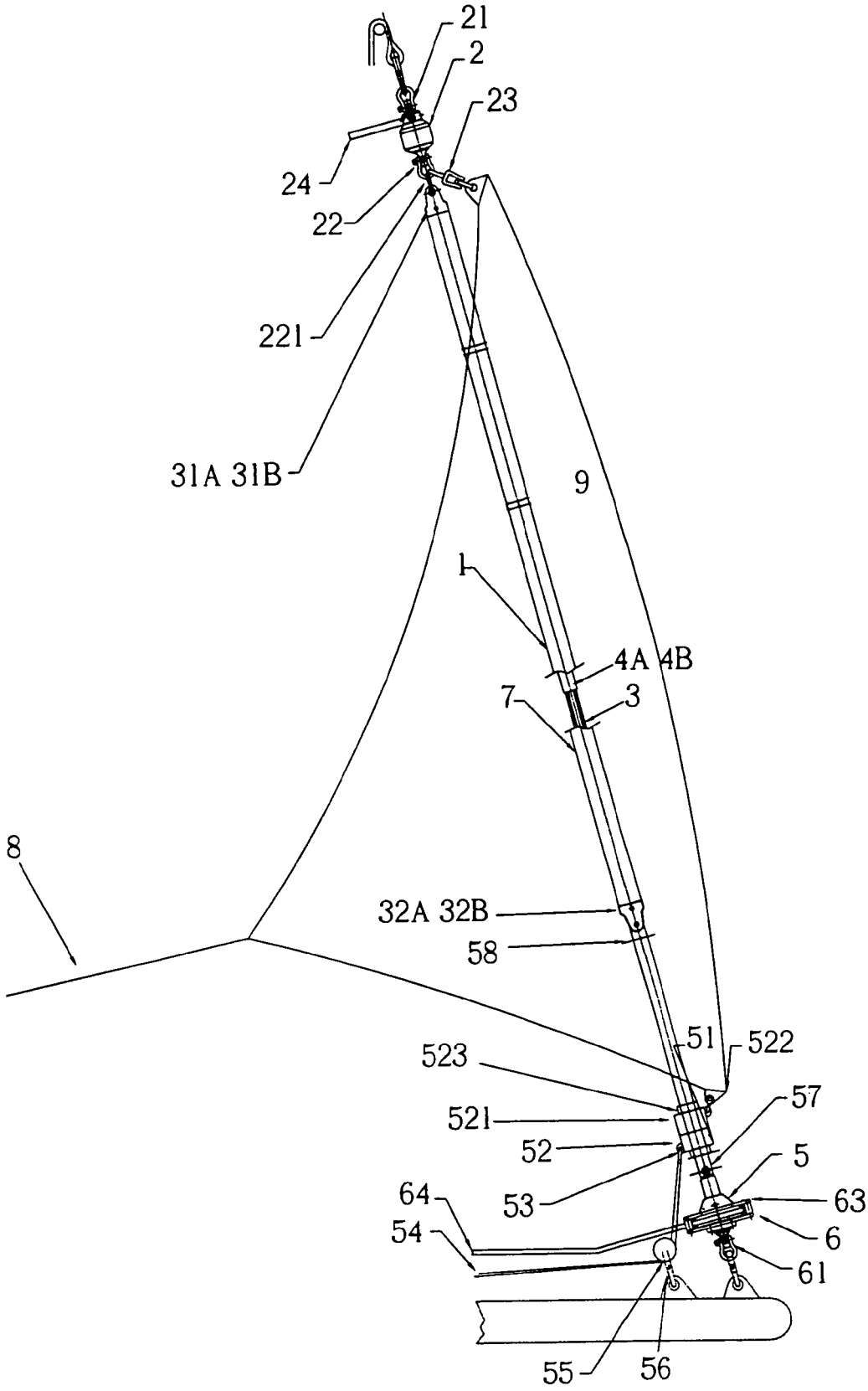

FIGS. 29-30 show how the bending of the sail inlet point is modified.

By operating the line 54, it is possible to modify the position of the slider 52 and change the distance between the halyard point and the tack point of the sail or bottom loading system 5.

Figure 31:
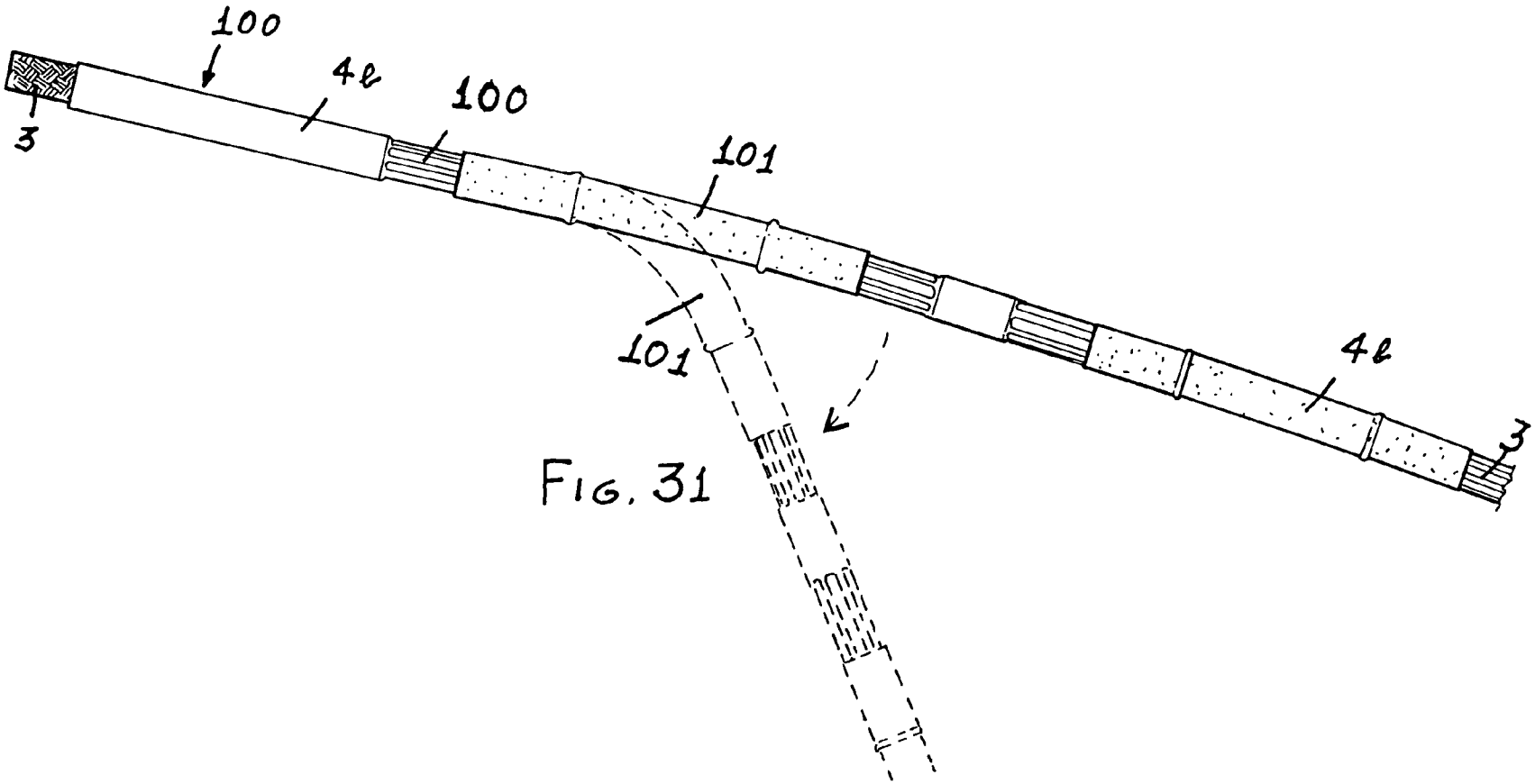
FIG. 31 illustrates a partially cross-sectioned side view of a modified embodiment including an inner stay foil on which is crimped, or clamped in any other suitable manner, an outer profiled element or foil preferably made of a metal material or other rigid material, divided into a plurality of suitable length segments, spaced by inner stay portions covered by a flexible plastic material coupling element.

FIG. 31 shows an improved embodiment of the device according to the present invention.

This figure, more specifically, shows an inner stay 3, thereon is caulked or clamped in any other suitable manner, an outer foil 4B, preferably of a metal or rigid material, comprising a plurality of segments 100 of suitable length, providing the assembly with high torsion rigidity features.

Said torsionally stiffened segments 100 are spaced from one another by inner stay portions 3, which are longitudinally flexible, and covered by a plastic material connecting element 101, also axially flexible, allowing the stay-sail assembly to be easily folded.

It has been found that the invention fully achieves the intended aim and objects.

In fact, the invention provides a furling device allowing to easily and quickly furl and unfurl unhoisted sails, such as asymmetric spinnakers, gennakers, MPS's, of conventional construction, as well as tails, drifters, reachers.

The device according to the invention can be easily used, and allows to drift and lower the sail, in a very simple manner, for one sailing with a short crew.

Moreover, the device according to the invention allows to easily control the shape of the sail at the wind inlet edge, while allowing the sail to be maneuvered from the cockpit.

Further, said device greatly improves the safety of the crew, during the operation of large size sails, such as asymmetric spinnakers or sails of the same type, such gennarkers or MPS's.

The device can be easily folded and, having a small size, can be easily stored in the storing bag together with the furled sail.

Another important advantage of the device according to the invention, is that it allows the sail to be maneuvered in a very simple and safe condition by the crew.

Thus, this feature allows to one sailing with a short crew to increase the frequency of use of downwind and the like sails.

In practicing the invention, the used materials, as well as the contingent size and shapes, can be any, depending on requirements.

The invention claimed is:

1. A furling and unfurling device for furling and unfurling on a sail boat asymmetric sails by a sail furling and unfurling system, said device comprising a tubular foil and an inner flexible stay foil arranged within said tubular foil, said tubular and inner foils forming a foil assembly adapted to transmit a furling torque for furling a non hoisted sail, which is furled on a sheath foil fitted on said tubular foil, said tubular, inner, and sheath foil being flexible, said inner foil comprising a sheet or rope, said tubular foil comprising a plurality of tubular segments made of a metal material or of a fiber reinforced plastic material, wherein said tubular segments are spaced from one another by coupling spacer flexible elements allowing said furling and unfurling system to be folded and stored.

2. A device according to claim 1, wherein said sheath foil comprises a plurality of tubular segments of a foamed rubber material, having a plurality of projections thereon.

3. A device according to claim 1, wherein said furling and unfurling system comprises a halyard swivel, having a halyard attachment terminal, a foil attachment terminal, a sail top swivel shackle and an anti-rotation rod element for preventing a torque provided by said furling and unfurling system from twisting the halyard, wherein said halyard swivel is coupled to said flexible inner foil, through a first terminal element, and said inner foil is coupled to a furling drum, through a second terminal element, a bottom loading system being arranged between said furling drum and said second terminal element.

4. A device according to claim 1, wherein said tubular foil comprises a twin tube, arranged between said halyard swivel and said furling drum.

5. A device according to claim 1, wherein said device further comprises a slider element for controlling a geometry of a sail attachment edge, said slider element sliding on a slider element rigid foil and having a top portion including a shackle element and a tack strap element for a bottom portion of said sail, said slider element having a slider element bottom portion including an attachment assembly for said bottom loading system.

6. A device according to claim 3, wherein said furling drum comprises an attachment terminal for connection to a boat deck and an endless furling and unfurling system for furling and unfurling said sail.

7. A device according to claim 1, wherein said device comprises two clamp terminals for locking said inner foil.

8. A device according to claim 7, wherein said clamp terminals operate on a single operating axis.

9. A device according to claim 1, wherein said sail boat comprises a swivel tack movable semi-rigid rod which is prevented from lowering under a threshold lowering position.

10. A device according to claim 9, wherein said movable semi-rigid rod is so designed and arranged as to increase a sail furling torque to prevent a bottom part of said sail from being furled before a furling of a top and middle portion of said sail.

11. A device according to claim 1, wherein said inner flexible stay foil comprises a plurality of segments spaced by longitudinal flexible inner foil portions.

12. A device according to claim 11, wherein said flexible portions are covered by an axially flexible plastic material coupling element allowing a stay-sail assembly to be easily folded.

13. A method for assembling a sail furling and unfurling device according to claim 1, wherein said method comprises the steps of assembling a plurality of rods on said inner foil, measuring a distance between a tack portion of a sail furling and unfurling system and a top swivel shackle of said system, calculating a distance measurement value, transferring said distance measurement value on a tubular foil and arranging and locking a bottom terminal clamp at said distance measurement value.

* * * * *